United States Patent [19]

Hasenclever

[11] 4,406,809

[45] Sep. 27, 1983

[54] DISINFECTING CLEANING INTENSIFIER FOR DRY CLEANING

[75] Inventor: Kaspar D. Hasenclever, Taunusstein, Fed. Rep. of Germany

[73] Assignee: Chemische Fabrik Kreussler & Co. GmbH, Wiesbaden, Fed. Rep. of Germany

[21] Appl. No.: 360,635

[22] Filed: Mar. 22, 1982

[30] Foreign Application Priority Data

Mar. 21, 1981 [DE] Fed. Rep. of Germany ..... 3111158

[51] Int. Cl.[3] ..... C11D 1/40; C11D 1/44; C11D 3/43; D06L 1/04

[52] U.S. Cl. ..... 252/106; 8/142; 252/153; 252/171; 252/544; 252/547; 252/548

[58] Field of Search ..... 8/142; 252/106, 142, 252/143, 153, 171, 544, 546, 548, 547

[56] References Cited

U.S. PATENT DOCUMENTS

| | | | |
|---|---|---|---|
| 1,836,047 | 12/1931 | Somerville | 252/544 |
| 3,057,676 | 10/1962 | Wedell | 252/544 |
| 3,095,373 | 6/1963 | Blomfield | 252/8.8 |
| 3,628,911 | 12/1971 | Grunewalder | 8/142 |
| 3,859,225 | 1/1975 | McKnight | 252/153 |
| 4,021,377 | 5/1977 | Borchert | 252/546 |
| 4,124,517 | 11/1978 | Hisamoto | 252/544 |
| 4,135,879 | 1/1979 | Hasenclever | 8/142 |
| 4,237,155 | 12/1980 | Kardouche | 427/242 |
| 4,292,035 | 9/1981 | Battrell | 8/137 |
| 4,338,204 | 7/1982 | Spadini | 252/8.75 |

FOREIGN PATENT DOCUMENTS

| | | | |
|---|---|---|---|
| 2905207 | 8/1979 | Fed. Rep. of Germany | 252/153 |

*Primary Examiner*—Dennis L. Albrecht
*Attorney, Agent, or Firm*—Michael J. Striker

[57] ABSTRACT

A disinfecting cleaning intensifier for dry cleaning is disclosed, containing—in addition to at least one disinfecting quaternary ammonium chloride surfactant and water—the diammonium salt of an aliphatic linear $\alpha$, $\omega$-dicarboxylic acid having from 2 to 5 methylene groups or the triammonium salt of a tricarboxylic acid, namely citric acid or tricarballylic acid, and a tertiary amine corresponding to the general formula $NR_1R_1R_2$ or $NR_1'R_1'R_2'$ in which $R_1$ represents methyl, $R_2$ represents a fatty alkyl group containing from 8 to 18 carbon atoms, $R_1'$ represents a hydroxy ethyl group $—CH_2—CH_2—OH$, and $R_2'$ represents an ethylene glycol monoalkyl ether radical corresponding to the following formula $$—CH_2—\underset{\underset{R_3}{|}}{CH}—O—CH_2—CH_2—OH$$

in which $R_3$ represents a fatty alkyl group containing from 10 to 18 carbon atoms, or a mixture of these tertiary ammonium salts. Preferred embodiments include for the cleaning intensifier to contain dialkyl dimethyl ammonium chloride or alkyl benzyl dimethyl ammonium chloride, each containing $C_8$–$C_{18}$-fatty alkyl groups, or a mixture of these quaternary ammonium salts as the disinfecting ammonium salt.

5 Claims, No Drawings

DISINFECTING CLEANING INTENSIFIER FOR DRY CLEANING

This invention relates to a combination of surfactants as a disinfectant, cleaning intensifier and outstanding discolouration reducing agent in dry cleaning baths.

The use of disinfectants in dry cleaning baths for protection against the transmission of pathogenic germs has long been known and repeatedly described (cf. for example K. Lindner, Tenside-Textilhilfsmittel-Waschrohstoff, Vol. III, page 2607, Wissenschaftliche Verlagsanstalt Stuttgart, 1971). Despite the basically necessary disinfecting effect, none of the disinfectants proposed hitherto and the methods for their application has ever been successful. Either the cost of the disinfectants originally used were too high or less expensive microbicides, such as formaldehyde for example, led to processing difficulties in dry cleaning (cf for example Fischer-Bobsien, Wascherei- und Reinigungspraxis 1979, No. 8, page 12). Although the development and use of surfactant combinations of disinfecting quaternary ammonium salts and non-ionic surfactants as cleaning intensifiers (cf. K. D. Hasenclever, Reiniger und Wascher 77 (1978), No. 5, page 60) made disinfection in dry cleaning baths less expensive, new problems arose in regard to the greying of the fabrics treated. To enable the disinfecting quaternary ammonium salts used in combination with non-ionic surfactants to develop their disinfecting effect to dry cleaning baths, the dry cleaning bath has to contain water which increases the relative air humidity in the vapour compartment of the cleaning machine to at least 75% (K. D. Hasenclever, Reiniger und Wascher 78 (1980), No. 7, page 25). However, this disinfecting cleaning process, which represents the state of the art, is attended by disadvantages insofar as, precisely on account of the—albeit small—water content of the cleaning bath required for disinfection, the cleaning of loads containing textiles dyed with substantive dyes can or does result partly in the detachment of dye anions which are absorbed and fixed with the quaternary ammonium ions of the disinfectant on woollen cotton where they cause serious dye-induced discolouration, thereby impairing the quality of cleaning of the load to a considerable extent. Although discolouration such as this can be reduced by adding to the cleaning intensifier/disinfectant surfactant combination anion-active surfactants, primarily esters of phosphoric acid, which react with cation-active constituents of the surfactant combination to form neutral salts, this has the effect of neutralising or at least greatly reducing the disinfecting effect of the cationic surfactants.

According to the invention, it has been found that dye-induced discolouration of the type referred to above can be completely eliminated providing from 5 to 30% by weight of an ammonium salt of tertiary fatty amines or tertiary N-alkyl-N-hydroxyethylamines and an aliphatic dicarboxylic acid or a tricarboxylic acid of the citric acid type is added to the disinfecting surfactant combination of cation-active and non-ionic surfactants (for a water content of the surfactant combination of from 10 to 40% by weight), the water content of the dry cleaning bath either emanates from the surfactant combination and/or is separately added and the surfactant combination is used in a concentration of from about 3 to 10 g/l of dry cleaning bath.

In addition to the elimination of dye-induced discolouration, pigment discolouration caused by the redeposition of detached dirt pigments is also distinctly reduced.

Amines which have proved to be particularly effective for the purposes of the invention are fatty amines of the alkyl dimethylamine type having a molecular weight of from 200 to 250 and tertiary hydroxy ethylamine derivatives containing a linear alkyl group and having a molecular weight of from 320 to 380.

The tertiary ammonium salts according to the invention may be represented by general formulae I to II' below:

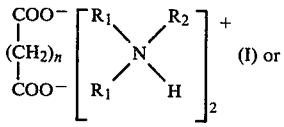

(I) or

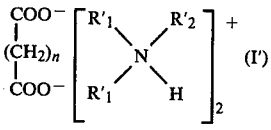

(I')

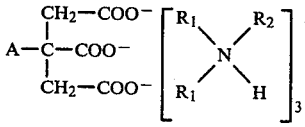

(II) or

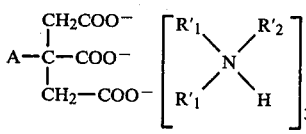

(II')

In the above formulae:

n is a number of from 3 to 5,

A represents a hydroxyl group (citric acid) or hydrogen (tricarballylic acid), $R_1$ represents methyl, $R_2$ represents a fatty alkyl group containing from 8 to 18 carbon atoms, $R_1'$ represents a hydroxyethyl group, $—CH_2—CH_2—OH$ and $R_2'$ represents a glycol monoalkyl ether radical corresponding to the formula $$—CH_2—\underset{\underset{R_3}{|}}{CH}—O—CH_2—CH_2—OH$$

in which $R_3$ represents a fatty alkyl group containing from 10 to 18 carbon atoms.

Particularly good results in regard to disinfection, cleaning intensification and reduction or prevention of discolouration in the dry cleaning of textiles are obtained with active substance or surfactant combinations according to the invention which—where 3 to 10 g of the mixture are used per liter of dry cleaning bath—contain in admixture:

from 5 to 30% by weight of a tertiary ammonium salt according to the invention corresponding to formulae I or I' and/or II or II' and among substances known in principle in the dry cleaning field from 10 to 40% by weight of a quaternary ammonium salt of the difatty alkyl dimethyl ammonium chloride and/or alkyl benzyl dimethyl ammonium chloride type, in each case containing $C_8$–$C_{18}$-fatty alkyl groups, from 20 to 50% by weight of a non-ionic surfactant, namely nonyl phenyl ethoxylate containing from 3 to 7 moles of ethylene oxide and/or fatty alcohol ethoxylate containing from 5 to 9 moles of ethylene oxide for a chain length of the fatty alcohol of from 12 to 16 carbon atoms and from 10 to 40% by weight of water.

In addition to suppressing dye-induced discolouration in dry-cleaning baths, the combination of active substances according to the invention —by virtue in particular of the tertiary ammonium salts of formulae I to II' used for the first time in the field in question—also greatly reduce the pigment-induced discolouration of the material to be cleaned by comparison with conventional surfactant combinations, improve the overall cleaning effect of the bath and increase the disinfecting effect of the bath beyond the level attainable by the quaternary ammonium salts as such.

The advantages of the combination of active substances or surfactants according to the present invention are illustrated by the following Examples.

EXAMPLE 1

The dye-induced discolouration and disinfection of textile fabrics in a dry cleaning bath using a surfactant combination according to the invention (disinfecting cleaning intensifier (A) according to the invention), a disinfecting cleaning intensifier (B) corresponding to the prior art and a conventional non-disinfecting cleaning intensifier (C) were compared in comparative tests.

Dye-induced discolouration was tested on white cotton test fabric produced by the Waschereiforschung Krefeld (WFK) which was added to a cleaning load of cotton fabric dyed with a substantive blue dye (blue jeans).

To this end, each cleaning intensifier was separately dissolved in tetrachloroethene in a mixing ratio of 10 g/l, after which dry cleaning was carried out under practical conditions in the resulting cleaning bath over a period of 15 minutes at a bath temperature of 30° C. with a liquor ratio of 1:5 (1 kg of textile fabrics per 5 liters of cleaning bath). Thereafter the dye-induced discolouration of the WFK-test fabric was determined photometrically as the percentage reduction in whiteness in relation to the original whiteness of the test fabric.

The disinfecting effect of the cleaning intensifiers was studied by the germ-carrier test on cotton cloths which had been contaminated with Staphylococcus aureus ATCC 6538 and with Pseudomonas aeruginosa ATCC 15442 (germ concentration approximately $3 \cdot 10^8/cm^2$). To this end, the cloths were treated for 15 minutes at 30° C. in dry cleaning baths of tetrachloroethene, to which the cleaning intensifiers had been added in concentrations of from 0.1 to 10 g/l of cleaning bath, in the absence of any other textiles and then disinhibited and incubated.

The disinfecting cleaning intensifier A according to the invention consisted of

15% by weight of the triammonium salt of coconut oil alkyl dimethylamine and citric acid, 10% by weight of didecyl dimethyl ammonium chloride and 15% by weight of coconut oil dialkyl dimethyl ammonium chloride, 15% by weight of the fatty alcohol ethoxylate of a $C_{12}/C_{14}$-fatty alcohol containing 7 moles of ethylene oxide, 20% by weight of nonyl phenyl ethoxylate containing 5 moles of ethylene oxide and 25% by weight of water.

The disinfecting cleaning intensifier B according to the prior art consisted of

10% by weight of coconut oil dialkyl dimethyl ammonium chloride, and

5% by weight of coconut oil alkyl benzyl dimethyl ammonium chloride,

30% by weight of nonyl phenyl ethoxylate containing 5 moles of ethylene oxide,

15% by weight of coconut oil fatty alcohol ethoxylate containing 7 moles of ethylene oxide and 40% by weight of water.

Finally, the non-disinfecting conventional cleaning intensifier C consisted of

20% by weight of potassium dodecyl benzene sulfonate,

15% by weight of glycerol monolaurate,

10% by weight of diethanol ammonium stearyl decaglycol diester phosphate,

15% by weight of nonyl phenyl ethoxylate containing 3 moles of ethylene oxide,

10% by weight of water and

30% by weight of tetrachloroethene.

The results of the discolouration and disinfection tests are shown in the following Table:

| | Cleaning Intensifier | | |
|---|---|---|---|
| | A | B | C |
| Dye-induced discolouration | 3.2% | 16% | 4.7% |
| Minimum concentration for killing off: | | | |
| *Staph. aureus* | 0.1 g/l | 2.5 g/l | ineffectual |
| *Ps. aeruginosa* | 1.0 g/l | 5.0 g/l | ineffectual |

It can be seen that, on the one hand, the disinfecting cleaning intensifier A according to the invention is germicidally active in a much lower concentration than the disinfecting cleaning intensifier B according to the prior art and that, on the other hand, the dye-induced discolouration in the case of the the cleaning intensifier A according to the invention is considerably less than in the case of the non-disinfecting conventional cleaning intensifier C, whereas the disinfecting cleaning intensifier B according to the prior art shows 5 times greater dye-induced discolouration for a moderate disinfecting effect.

EXAMPLE 2

A comparison was made of the cleaning effect, the overall discolouration and the disinfecting effect of a disinfecting cleaning intensifier D according to the invention consisting of 20% by weight of the triammonium citrate salt of a tertiary hydroxy ethylamine derivative corresponding to the formula $$HO-C_2H_4-O-\underset{\underset{R}{|}}{CH}-CH_2-N(C_2H_4-OH)_2,$$

where R is a $C_{12}/C_{14}$ fatty alkyl radical,

15% by weight of coconut oil alkyl benzyl dimethyl ammonium chloride,

10% by weight of coconut oil dialkyl dimethyl ammonium chloride,
30% by weight of nonyl phenyl ethoxylate containing 7 moles of ethylene oxide and
25% by weight of water, and of the cleaning intensifiers B and C of Example 1.

To this end, a standard 12 kg capacity dry cleaning machine was filled with separate loads of trousers of comparable origin and soiling together with partly artificially soiled and partly white WFK-cotton test fabric and dry-cleaned with the same liquor ratio in tetrachloroethene, to which quantities of 5 g/l of one of the cleaning intensifiers had been added, after which the cleaning effect and the overall discolouration were determined with the aid of the soiled and the white test fabrics whilst the disinfecting effect was determined by dabbing the load onto germ indicators (Manufacturer: BIOTEST-Serum-Institut GmbH).

The cleaning effect is expressed as the percentage increase in whiteness of the artificially soiled test fabric, discolouration as the percentage reduction in whiteness of the white test fabric—as measured electrophotometrically in each case—and the disinfecting effect as the percentage of non-infected germ indicators after cleaning, based on the number of infected germ indicators before cleaning. The results are set out in the following Table.

| | Cleaning Intensifier | | |
|---|---|---|---|
| | D | B | C |
| Cleaning effect | 58% | 42% | 44% |
| Discolouration | 1.1% | 4.7% | 3.2% |
| Disinfection | 100 | 100 | 38 |

The surfactant combination or the cleaning intensifier D according to the invention shows a distinct improvement in the cleaning effect and also a distinct reduction in discolouration by comparison with the conventional cleaning intensifiers B and C as representatives of the prior art. In addition, the material treated with the cleaning intensifier D was distinguished from the material treated with cleaning intensifiers B and C by clearer colours and a fresher smell.

EXAMPLE 3

Further surfactant combinations (disinfecting cleaning intensifiers) E, F, G, and H according to the invention and the conventional cleaning intensifiers B and C of the previous Examples were compared with one another in regard to the cleaning effect of tetrachloroethene baths each containing one of the cleaning intensifiers to be compared, in regard to the overall discolouration of the material cleaned in these baths, in regard to the part played by the cleaning intensifiers in the transfer of dyes from dyed to white textiles and in regard to the bactericidal effect of the cleaning intensifiers.

The composition of the cleaning intensifiers according to the invention is shown in the following Table:

| Composition in % by weight | E | F | G | H |
|---|---|---|---|---|
| Ammonium salt of 2 moles of n-decyldimethylamine 1 mole of adipic acid | 7 | | | |
| 3 moles of n-decyldimethylamine 1 mole of tricarballylic acid | | 10 | | |
| 3 moles of lauryl dimethylamine 1 mole of citric acid | | | 10 | |
| 3 moles of stearyldimethylamine 1 mole of citric acid | | | | 10 |
| Didecyl dimethyl ammonium chloride | 5 | 5 | 5 | 5 |
| Coconut oil dialkyl dimethyl ammonium chloride | 15 | 15 | 15 | 15 |
| Nonyl phenyl ethoxylate containing 5 moles of ethylene oxide | 20 | 25 | 20 | 30 |
| Fatty alcohol ethoxylate of $C_{12}/C_{14}$ - alcohol containing 7 moles of ethylene oxide | 15 | 10 | 20 | 10 |
| Water | 38 | 35 | 30 | 30 |

In order to determine the cleaning effect and the degree of discolouration, artificially soiled and white WFK test fabrics were cleaned for 15 minutes at 30° C. in a laboratory Launder-O-Meter (Manufacturer: Original Hanau) filled with 400 ml of a cleaning solution of tetrachloroethene and quantities of 5 g/l of one of the cleaning intensifiers B to H, after which the cleaning effect was electrophotometrically determined as the percentage increase in whiteness of the soiled test fabrics and discolouration as the percentage reduction in whiteness of the white test fabrics, based in each case on the original degree of whiteness.

In order to assess the part played by the cleaning intensifiers in the transfer of dyes, the transfer of dye from cotton which had been dyed with a substantive blue dye to white cotton (staining) in accordance with DIN 54023 (Determining the Resistance to Solvents of Dyeing and Printing), but using an electrophotometer rather than the so-called grey scale.

The bacericidal effect of the cleaning intensifiers was determined as the minimum inhibiting concentration of the cleaning intensifiers in the suspension test according to Section C II/3 of the Guidelines of the German Society for Hygiene and Microbiology using Staphylococcus aureus ATCC 6538 in an initial concentration of $5 \cdot 10^8$/ml.

The test results are set out in the following Table.

| | Cleaning Intensifier according to the invention | | | | Conventional cleaning intensifier | |
|---|---|---|---|---|---|---|
| | E | F | G | H | B | C |
| cleaning effect | 26% | 28% | 33% | 24% | 22% | 24% |
| Discolouration | 2.3% | 1.7% | 0.9% | 1.4% | 3.4% | 2.8% |
| Staining | 5.3% | 2.3% | 1.8% | 3.4% | 11.5% | 4.7% |
| Minimum inhibiting concentration | 1.2 g/l | 0.5 g/l | 0.5 g/l | 1.5 g/l | 1.5 g/l | nil |

By comparison with the disinfecting cleaning intensifier B and the non-disinfecting cleaning intensifier C, cleaning intensifiers, E, F, G and H according to the invention again proved to be distinctly better overall discolouration inhibitors and—with the exception of the surfactant combination H which cleans equally well—the more powerful cleaners. Compared with B as a conventional disinfecting cleaning intensifier, the cleaning intensifiers according to the invention—again with the exception of the equally germicidally active surfactant combination H—are the more powerful disinfectants and—critically—also cause much less dye to be transferred. With the exception of E, the transfer of dye is considerably lower, even by comparison with the non-disinfecting cleaning intensifier C.

In overall terms, the Examples show that the object of the present invention, namely to eliminate the excessive discolouration occurring as a secondary effect in the dry cleaning of textiles using conventional disinfecting cleaning intensifiers as opposed to non-disinfecting cleaning intensifiers, is not only achieved by the disinfecting cleaning intensifiers according to the invention, a far greater reduction or prevention of discolouration coupled with a considerably better cleaning and disinfecting effect are also obtained. This is attributable to the tertiary ammonium salts according to the invention which synergistically strengthen these components functions of disinfecting cleaning intensifiers. Instead of being used individually, as shown in the Examples, these salts may of course also be used in the form of mixtures in regard to the acids or tertiary amines.

I claim:

1. A disinfecting cleaning intensifier for dry cleaning, comprising in addition to at least one disinfecting quaternary ammonium chloride, a non-ionic surfactant and water, the diammonium salt of an aliphatic linear $\alpha,\omega$-dicarboxylic acid containing from 2 to 5 methylene groups or the triammonium salt of a tricarboxylic acid and a tertiary amine corresponding to the general formula $NR_1R_1R_2$ or $NR_1'R_1'R_2'$ in which $R_1$ represents methyl, $R_2$ represents a fatty alkyl group containing from 8 to 18 carbon atoms, $R_1'$ represents a hydroxy ethyl group, $—CH_2—CH_2—OH$, and $R_2'$ represents an ethylene glycol monoalkyl ether radical corresponding to the following formula $$—CH_2—\underset{\underset{R_3}{|}}{CH}—O—CH_2—CH_2—OH$$

in which R represents a fatty alkyl group containing from 10 to 18 carbon atoms, or a mixture of these tertiary ammonium salts wherein said components are in amounts and proportions effective to reduce pigment-induced discoloration, improve overall cleaning effect and increase disinfecting effect.

2. A cleaning intensifier as claimed in claim 1, characterised in that it contains dialkyl dimethyl ammonium chloride or alkyl benzyl dimethyl ammonium chloride, each containing $C_8$–$C_{18}$-fatty alkyl groups, or a mixture of these quaternary ammonium salts as the disinfecting ammonium salt.

3. A cleaning intensifier as claimed in claim 1, characterised in that it contains nonyl phenyl ethoxylate containing from 3 to 7 moles of ethylene oxide and/or fatty alcohol ethoxylate containing from 5 to 9 moles of ethylene oxide for a chain length of the alcohol of from 12 to 16 carbon atoms as the non-ionic surfactant.

4. A cleaning intensifier as claimed in claims 1, 2 or 3, characterised by the following composition:

from 5 to 30% by weight of a tertiary ammonium salt of the type claimed in claim 1, from 10 to 40% by weight of a quaternary ammonium salt of the type claimed in claim 2, from 20 to 50% by weight of a non-ionic surfactant of the type claimed in claim 3 and from 10 to 40% by weight of water.

5. A dry-cleaning bath containing from about 3 to 10 g/l of the disinfecting cleaning intensifier claimed in claim 4.

* * * * *